US007159391B2

(12) United States Patent
Kogo et al.

(10) Patent No.: US 7,159,391 B2
(45) Date of Patent: Jan. 9, 2007

(54) METHOD FOR RESTRICTING EXCESSIVE TEMPERATURE RISE OF FILTER IN INTERNAL COMBUSTION ENGINE

(75) Inventors: Tomoyuki Kogo, Susono (JP); Takeshi Hashizume, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 246 days.

(21) Appl. No.: 10/936,606

(22) Filed: Sep. 9, 2004

(65) Prior Publication Data

US 2005/0060992 A1 Mar. 24, 2005

(30) Foreign Application Priority Data

Sep. 22, 2003 (JP) ..... 2003-329801

(51) Int. Cl.
*F01N 3/00* (2006.01)

(52) U.S. Cl. ..... 60/297; 60/274; 60/277; 60/285; 60/295; 60/298

(58) Field of Classification Search ..... 60/274, 60/285, 295, 297, 300, 311, 277, 298
See application file for complete search history.

(56) References Cited

U.S. PATENT DOCUMENTS 6,634,170 B1 * 10/2003 Hiranuma et al. ..... 60/295
6,668,792 B1 * 12/2003 Yamauchi et al. ..... 123/295
6,763,659 B1 * 7/2004 Watanabe et al. ..... 60/297
6,851,258 B1 * 2/2005 Kawashima et al. ..... 60/311
6,969,413 B1 * 11/2005 Yahata et al. ..... 55/282.3
6,988,361 B1 * 1/2006 van Nieuwstadt et al. .... 60/295
2005/0072141 A1 * 4/2005 Kitahara ..... 60/297

FOREIGN PATENT DOCUMENTS

| | | |
|---|---|---|
| EP | 1 245 814 A2 | 10/2002 |
| FR | 2 829 526 | 3/2003 |
| JP | 63-079814 A | 4/1986 |
| JP | A-61-079814 | 4/1986 |
| JP | 2002-285897 A | 10/2002 |
| JP | 2003-1721724 A | 6/2003 |

* cited by examiner

*Primary Examiner*—Tu M. Nguyen
(74) *Attorney, Agent, or Firm*—Oliff & Berridge, PLC

(57) ABSTRACT

A method for restricting an excessive temperature rise in an internal combustion engine according to the present invention can provide a technology that enable to restrict an excessive temperature rise of a filter more reliably in an internal combustion engine having the filter provided in the exhaust passage for collecting particulate matter in the exhaust gas. In that method, when the running state of the internal combustion engine becomes idle running during the filter regeneration process, the oxygen concentration in the exhaust gas flowing into the filter is reduced. After that, when the running state of the internal combustion engine shifts from the idle running to a running state with an engine load higher than in the idle running, the oxygen concentration in the exhaust gas flowing into the filter is gradually increased.

24 Claims, 3 Drawing Sheets

METHOD FOR RESTRICTING EXCESSIVE TEMPERATURE RISE OF FILTER IN INTERNAL COMBUSTION ENGINE

BACKGROUND OF THE INVENTION

1. Field of the Invention

The present invention relates to a filter excessive temperature rise restricting method for restricting an excessive temperature rise of a filter in an internal combustion engine equipped with the filter for collecting particulate matter contained in the exhaust gas provided in the exhaust passage.

2. Description of the Related Art

Internal combustion engines having a filter provided in the exhaust passage to collect particulate matter such as soot contained in the exhaust gas are known. In the internal combustion engine having a filter, a filter regeneration process is performed when the amount of the particulate matter depositing on the filter becomes equal to or larger than a specified amount. In the filter regeneration process, the temperature of the filter is raised to oxidize and remove the particulate matter depositing on the filter.

In the filter regeneration process, there is a risk that the temperature of the filter can be raised excessively by the heat generated by oxidation of the particulate matter, so that heat deterioration of the filter can be accelerated or the filter can be melted. In view of this, there is a known technology in which fuel injection in the form of post injection is regulated based on the flow quantity of the exhaust gas to control the oxygen concentration in the exhaust gas, thereby restricting an excessive temperature rise of the filter (see, for example, Japanese Patent Application Laid-Open No. 2002-285897). There is another known technology in which when the temperature of the filter is high and the oxygen concentration in the exhaust gas is high at the time when the running state of an internal combustion engine shifts from high load running to idle running, the oxygen concentration in the exhaust gas is reduced, thereby restricting an excessive temperature rise of the filter (see, for example, Japanese Patent Publication No. 5-11205). There is still another known technology in which when an internal combustion engine comes to a running state that requires restriction of autoignition of the particulate matter depositing on the filter, fuel injection quantity in pilot injection is increased, thereby restricting an excessive temperature rise of the filter (see, for example, Japanese Patent Application Laid-Open No. 2003-172124).

As described in the above, in the internal combustion engine equipped with a filter for collecting particulate matter contained in the exhaust gas provided in the exhaust passage, when the risk of an excessive temperature rise of the filter becomes high during the filter regeneration process, the oxygen concentration in the exhaust gas is reduced to suppress oxidation of the particulate matter, thereby restricting an excessive temperature rise of the filter.

In that case, while the oxygen concentration in the exhaust gas is made low, removal of the particulate matter from the filter hardly proceeds. Consequently, after reducing the oxygen concentration in the exhaust gas, even in the case that the possibility of an excessive temperature rise has been made low, a steep increase in the oxygen concentration can bring about an excessive temperature rise of the filter due to rapid oxidation of the particulate matter remaining on the filter without being removed.

SUMMARY OF THE INVENTION

The present invention has been made in view of the above-describe problem. The present invention is directed to an internal combustion engine having a filter for collecting particulate matter contained in the exhaust gas provided in the exhaust passage, and an object of the present invention is to provide a technology for restricting an excessive temperature rise of the filter more reliably.

In order to attain the above object, the present invention adopts the following means.

That is, according to the present invention, while the oxygen concentration in the exhaust gas flowing into a filter is kept low in order to restrict a rise in the temperature of the filter, if the possibility of an excessive temperature rise decreases, the oxygen concentration in the exhaust gas flowing into the filter is gradually increased.

More specifically, in a method for restricting an excessive temperature rise of a filter in an internal combustion engine according to the present invention, the internal combustion engine has a filter provided in an exhaust passage for collecting particulate matter contained in exhaust gas, and when the amount of particulate matter depositing on the filter becomes equal to or larger than a specified deposition amount, the temperature of the filter is raised to oxidize and remove the particulate matter depositing on the filter. The method is characterized by that when a condition with which it is anticipated that the temperature of said filter will become equal to or higher than a specified temperature is established while the removal of particulate matter from said filter is performed, the oxygen concentration in the exhaust gas flowing into said filter is decreased, and when after that said condition expires, the oxygen concentration in the exhaust gas flowing into said filter is gradually increased.

Here, the specified deposition amount is an amount smaller than the amount that involves the risk that the temperature of the filter can be raised excessively by the heat generated by oxidation of the particulate matter. The specified deposition amount is determined in advance by experiments and so on. The specified temperature is such a temperature that when the temperature of the filter becomes higher than or equal to the specified temperature, it can be determined that an excessive rise in the temperature of the filter is occurring. In other words, when the temperature of the filter becomes larger than or equal to the specified temperature, there arises a risk that heat deterioration of the filter can be accelerated or the filter can be melted. The specified temperature is also determined in advance by experiments and so on.

In the present invention, when the condition with which it is anticipated that the temperature of the filter will become equal to or higher than the specified temperature is established, the oxygen concentration in the exhaust gas flowing into the filter (which will be referred to as the inflowing exhaust gas, hereinafter) is reduced to restrict oxidation of the particulate matter. As a result, an excessive temperature rise of the filter can be restricted.

In addition, in the present invention, if the condition with which it is anticipated that the temperature of the filter will become equal to or higher than the specified temperature expires while the temperature rise of the filter is restricted by lowering the oxygen concentration in the inflowing exhaust gas, the oxygen concentration in the inflowing exhaust gas is gradually increased.

As discussed before, even when the condition with which it is anticipated that the temperature of the filter will become equal to or higher than the specified temperature expires, if the oxygen concentration in the inflowing exhaust gas increases steeply, the particulate matter remaining on the filter will be oxidized rapidly. Consequently, the temperature of the filter can be raised rapidly, and the risk of an excessive temperature rise arises.

According to the present invention, when the condition with which it is anticipated that the temperature of the filter will become equal to or higher than the specified temperature expires, the oxygen concentration of the inflowing exhaust gas is gradually increased. Accordingly, oxidation of the particulate matter proceeds gradually. Therefore, it is possible to restrict a steep temperature rise of the filter. Thus, it is possible to restrict an excessive temperature rise of the filter.

In the internal combustion engine according to the present invention, in at least one of the case that a catalyst having an oxidizing function is carried on the filter and the case that a catalyst having an oxidizing function is provided in the exhaust passage upstream of the filter, the oxygen concentration in the inflowing exhaust gas may be decreased or increased by adjusting at least one of the injection quantity in the sub fuel injection effected in the internal combustion engine during a period other than main fuel injection and the addition quantity of a reducing agent added to the exhaust gas in the upstream of said filter.

The sub fuel injection is fuel injection that is performed during the period in which its influence on the engine load of the internal combustion engine is small.

When the injection quantity in the sub fuel injection and/or the addition quantity of the reducing agent added to the exhaust gas is increased, the quantity of oxygen consumed in oxidation of the fuel and/or the reducing agent will increase. Consequently, the oxygen concentration in the inflowing exhaust gas can be lowered. On the other hand, when the injection quantity in the sub fuel injection and/or the addition quantity of the reducing agent added to the exhaust gas is decreased, the quantity of oxygen consumed in oxidation of the fuel and/or the reducing agent will decrease. Consequently, the oxygen concentration in the inflowing exhaust gas can be raised.

In the case that the oxygen concentration in the inflowing exhaust gas is increased or decreased by the above-described control process, a sub fuel injection quantity that is aimed at in adjusting the injection quantity in the sub fuel injection (which will be referred to as the target sub fuel injection quantity, hereinafter) and a reducing agent addition quantity that is aimed at in adjusting the addition quantity of the reducing agent (which will be referred to as the target reducing agent addition quantity, hereinafter) may be corrected based on a condition of the atmosphere.

For example, when the atmospheric pressure is low or the atmospheric temperature is high, the quantity of oxygen contained in the same volume of air is smaller than in the normal atmospheric pressure condition or the normal atmospheric temperature condition. In view of this, when the oxygen concentration in the inflowing exhaust gas is to be adjusted to a targeted oxygen concentration (which will be referred to as the target oxygen concentration), in the case that the atmospheric pressure is low or the atmospheric temperature is high, the target sun fuel injection quantity and the target reducing agent addition quantity are corrected to be made smaller than in the normal atmospheric pressure condition or the normal atmospheric temperature condition. On the other hand, when the atmospheric temperature is low, the quantity of oxygen contained in the same volume of air is larger than in the normal temperature condition. Therefore, when the oxygen concentration in the inflowing exhaust gas is to be adjusted to the targeted oxygen concentration, in the case that the atmospheric temperature is low, the target sub fuel injection quantity and the target reducing agent addition quantity are corrected to be made larger than in the normal atmospheric temperature condition. In other words, when the oxygen concentration in the inflowing exhaust gas is to be adjusted to the targeted oxygen concentration, the lower the atmospheric pressure is, or the higher the atmospheric temperature is, the smaller the target sub fuel injection quantity and the target reducing agent addition quantity are made by the correction.

In addition, when the oxygen concentration in the inflowing exhaust gas is gradually increased, the injection quantity in the sub fuel injection and/or the addition quantity of the reducing agent added to the exhaust gas may be gradually decreased, and the decreasing rate thereof may be corrected based on at least one of the atmospheric pressure and the atmospheric temperature.

By such correction, the oxygen concentration in the inflowing exhaust gas can be adjusted to the target oxygen concentration more accurately. Thus, the temperature of the filter can be controlled with improved accuracy, and therefore it is possible to restrict an excessive temperature rise of the filter more reliably.

If a catalyst having an oxidizing function is not carried on the filter nor provided in the exhaust passage upstream of the filter, the oxygen concentration in the inflowing exhaust gas is decreased or increased by at least controlling a combustion condition in the internal combustion engine.

In the present invention, in controlling the oxygen concentration in the inflowing exhaust gas, the intake air quantity in the internal combustion engine may be controlled in addition to the injection quantity in the sub fuel injection and/or the addition quantity of the reducing agent being adjusted. Specifically, when the oxygen concentration in the inflowing exhaust gas is to be lowered, the intake air quantity may be decreased, and when the oxygen concentration in the inflowing exhaust gas is to be raised, the intake air quantity may be increased.

As per the above, by adjusting the intake air quantity in the internal combustion engine also, it is possible to reduce the adjusting amount of the sub fuel injection quantity and/or the reducing agent addition quantity in increasing or decreasing the oxygen concentration in the inflowing exhaust gas. Consequently, in the process of reducing the oxygen concentration in the inflowing exhaust gas, it is possible to reduce the oxygen concentration in the inflowing exhaust gas while restricting the rise in the filter temperature with the smaller sub fuel injection quantity and/or with the smaller reducing agent addition quantity. Therefore, it is possible to restrict emission of unburned components (i.e. fuel and/or reducing agent) to the atmosphere, and a decrease in gas mileage can be restricted.

Furthermore, in the case that the intake air quantity is also adjusted in controlling the oxygen concentration in the inflowing exhaust gas, a targeted intake air quantity (which will be referred to as the target intake air quantity, hereinafter) may be corrected based on a condition of the atmosphere as with the sub fuel injection quantity and the reducing agent addition quantity.

In this case, when the oxygen concentration in the inflowing exhaust gas is to be increased gradually, the intake air quantity may be gradually increased and the increasing rate thereof may be corrected based on at least one of the atmospheric pressure and the atmospheric temperature.

By such correction, the oxygen concentration in the inflowing exhaust gas can be adjusted to the target oxygen concentration more accurately as with the above process. Thus, the temperature of the filter can be controlled with improved accuracy, and therefore it is possible to restrict an excessive temperature rise of the filter more reliably.

In the present invention, the establishment of the condition with which it is anticipated that the temperature of the filter will become equal to or higher than the specified temperature may correspond, for example, to the time when the running state of the internal combustion engine becomes idle running. This is because when the running state of the internal combustion engine becomes idle running, the quantity of the heat generated by oxidation of the particulate matter that is carried away by the exhaust gas (which will be referred to as the quantity of the removed heat, hereinafter) decreases with a decrease in the flow quantity of the exhaust gas, and therefore the temperature of the filter is easy to rise.

Furthermore, in the present invention, the expiration of the condition with which it is anticipated that the temperature of the filter will become equal to or higher than the specified temperature may correspond, for example, to the time when the running state of the internal combustion engine becomes a running state with an engine load higher than in the idle running. This is because when the engine load of the internal combustion engine becomes high, the quantity of the removed heat increases with an increase in the flow quantity of the exhaust gas, and therefore the temperature of the filter hardly rises.

In connection with this, the time when the running state of said internal combustion engine becomes a low load running in which the flow quantity of the exhaust gas is so low that the temperature of the filter is easy to rise may be interpreted as the establishment of the aforementioned condition even if the internal combustion engine is not in idle running. In addition, the time when the running state of the internal combustion engine shifts from such low load running to a high load running may be interpreted as the expiration of the aforementioned condition.

When the intake air quantity in said internal combustion engine becomes larger than or equal to a specified intake air quantity after the expiration of the condition with which it is anticipated that the temperature of the filter will become equal to or higher than the specified temperature, restriction of an increase in the oxygen concentration in the inflowing exhaust gas may be prohibited.

When the intake air quantity increases, the flow quantity of the exhaust gas will also increase. Therefore, the quantity of the removed heat also increases. Here, the specified intake air quantity is such a quantity that when the intake air quantity becomes larger than or equal to the specified intake air quantity, the flow quantity of the exhaust gas will become larger than or equal to the specified flow quantity of the exhaust gas. The specified flow quantity of the exhaust gas is such a flow quantity that when the flow quantity of the exhaust gas becomes larger than or equal to the specified flow quantity of the exhaust gas, the quantity of the removed heat becomes larger than or equal to the quantity of the heat generated by oxidation of the particulate matter. When the quantity of the removed heat becomes larger than the quantity of the heat generate by oxidation of the particulate matter, an excessive temperature rise of the filter hardly occurs, even if the oxygen concentration in the inflowing exhaust gas increases to some extent.

In view of the above, in the above control process, when the intake air quantity becomes larger than or equal to the specified intake air quantity, restriction of an increase in the oxygen concentration in the inflowing exhaust gas is prohibited. In other words, a control process for restricting a steep increase in the oxygen concentration in the inflowing exhaust gas is suspended. By this feature, it is possible to change the control process to a normal control process at an earlier stage. Consequently, it is possible to increase the oxygen concentration in the exhaust gas at an earlier stage while restricting an excessive temperature rise of the filter. Therefore, emission of unburned components (i.e. fuel and/or reducing agent) to the atmosphere can be restricted. In addition, when the filter generation process is continued, the removal of the particulate matter from the filter can be restarted earlier. Furthermore, in the case that the control for restricting an increase in the oxygen concentration in the inflowing exhaust gas is performed by the sub fuel injection or by adding fuel to the exhaust gas, a decrease in gas mileage can be restricted.

The above and other objects, features and advantages of the present invention will become more readily apparent to those skilled in the art from the following detailed description of a preferred embodiment of the present invention taken in conjunction with the accompanying drawings.

DESCRIPTION OF THE PREFERRED EMBODIMENT

In the following, an embodiment in which the method of restricting an excessive temperature rise of a filter in an internal combustion engine according to the present invention is applied will be described with reference to accompanying drawings.

Figure 1:
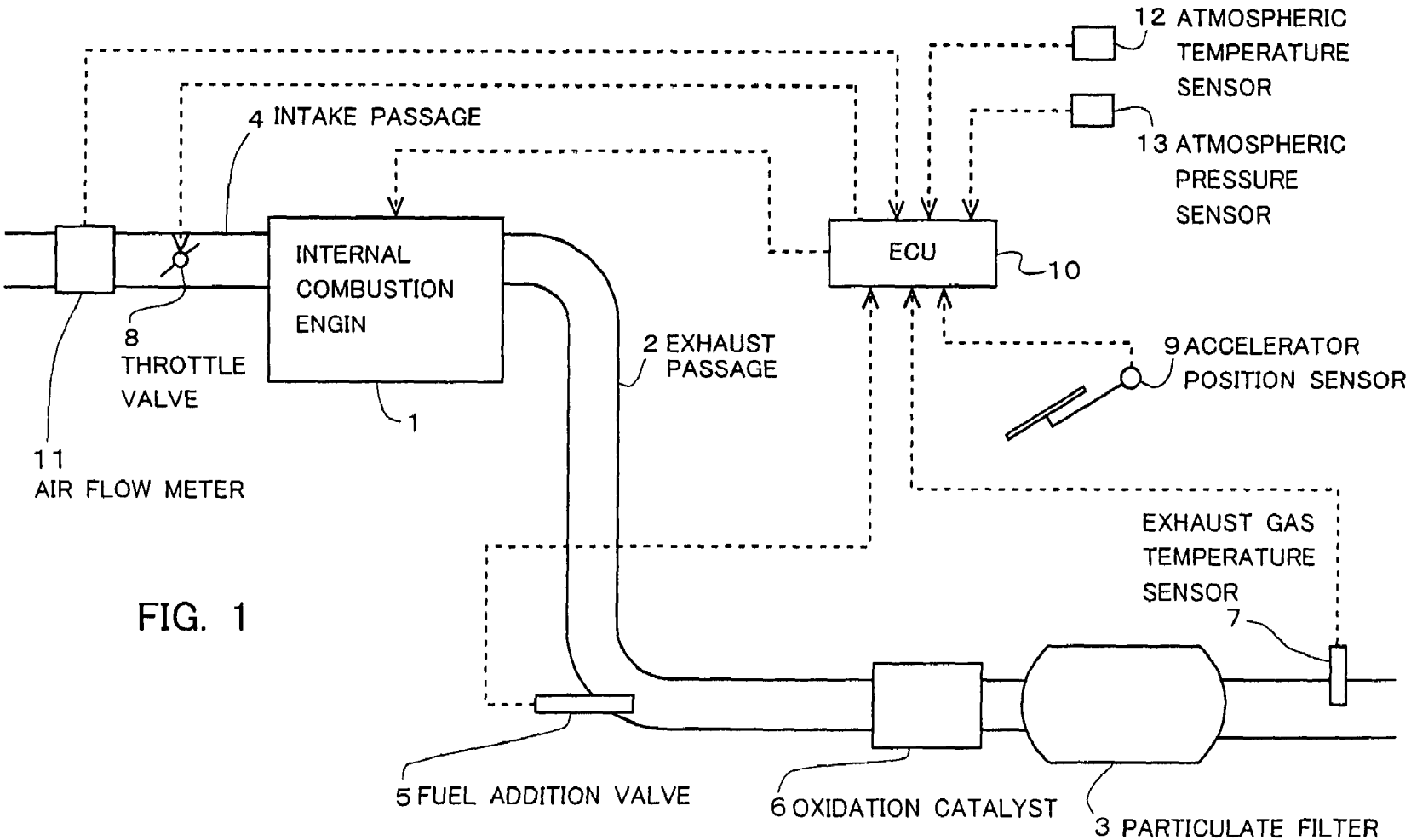
FIG. 1 is a view showing the schematic construction of an internal combustion engine, its intake, exhaust systems and its control system according to an embodiment of the present invention.

Here, the description will be directed to the case in which the present invention is applied to a diesel engine for driving vehicles. FIG. 1 is a view showing the schematic construction of an internal combustion engine, its intake, exhaust systems and its control system according to this embodiment.

The internal combustion engine 1 is a diesel engine for driving vehicles. The internal combustion engine 1 is connected with an intake passage 4 and an exhaust passage 2. In the intake passage 4, an air flow meter 11 and a throttle valve 8 are provided. On the other hand, in the exhaust passage 2, a particulate filter 3 (which will be simply referred to as the filter 3, hereinafter) for collecting particulate matter such as soot contained in the exhaust gas and an oxidation catalyst 6 disposed in the upstream of the filter 3 are provided. Instead of providing the oxidation catalyst 6 in the exhaust passage 2 upstream of the filter 3, an oxidation catalyst may be carried on the filter 3. As the oxidation catalyst 6, any catalyst having an oxidizing function may be used. For example, the oxidation catalyst 6 may be an NOx storage reduction catalyst.

At a position on the exhaust passage 2 upstream of the oxidation catalyst 6, there is provided a fuel addition valve 5 for adding fuel serving as a reducing agent to the exhaust gas. At a position on the exhaust passage 2 downstream of the filter 3, there is provided an exhaust gas temperature sensor 7 for outputting an electric signal indicative of the temperature of the exhaust gas flowing in the exhaust passage 2.

To the internal combustion engine 1 having the above-described structure, an electronic control unit (ECU) 10 is annexed. The ECU 10 is a unit for controlling the running state of the internal combustion engine 1 in accordance with running conditions of the internal combustion engine 1 or drivers demands. The ECU 10 is connected with various sensors such as the air flow meter 11, the exhaust gas temperature sensor 7, an accelerator position sensor 9 that outputs an electric signal indicative of the accelerator position, an atmospheric temperature sensor 12 that outputs an electric signal indicative of the atmospheric temperature and an atmospheric pressure sensor 13 that outputs an electric signal indicative of the atmospheric pressure. The output signals from the various sensors are inputted to the ECU 10. The ECU 10 derives the engine load of the internal combustion engine 1 from the output value of the accelerator position sensor 9 and estimates the temperature of the filter 3 based on the output value of the exhaust gas temperature sensor 7. In addition, the ECU 10 is electrically connected with the fuel addition valve 5 and the fuel injection valves of the internal combustion engine 1 etc. Thus, they are controlled by the ECU 10.

In this embodiment, when the amount of the particulate matter depositing on the filter 3 becomes equal to or larger than a specified deposition amount, the ECU 10 executes a filter regeneration process. In this process, the ECU 10 controls the fuel injection in the internal combustion engine 1, the fuel addition by the fuel addition valve 5 or other factors to raise the temperature of the filter 3, thereby oxidize and remove the particulate matter depositing on the filter 3. The specified deposition amount is an amount smaller than the amount that involves the risk that the temperature of the filter can excessively be raised by the heat generated by oxidation of the particulate matter. The specified deposition amount is determined in advance by experiments and so on. The filter regeneration process may be executed every predetermined period of time or every predetermined distance traveled.

Figure 2:
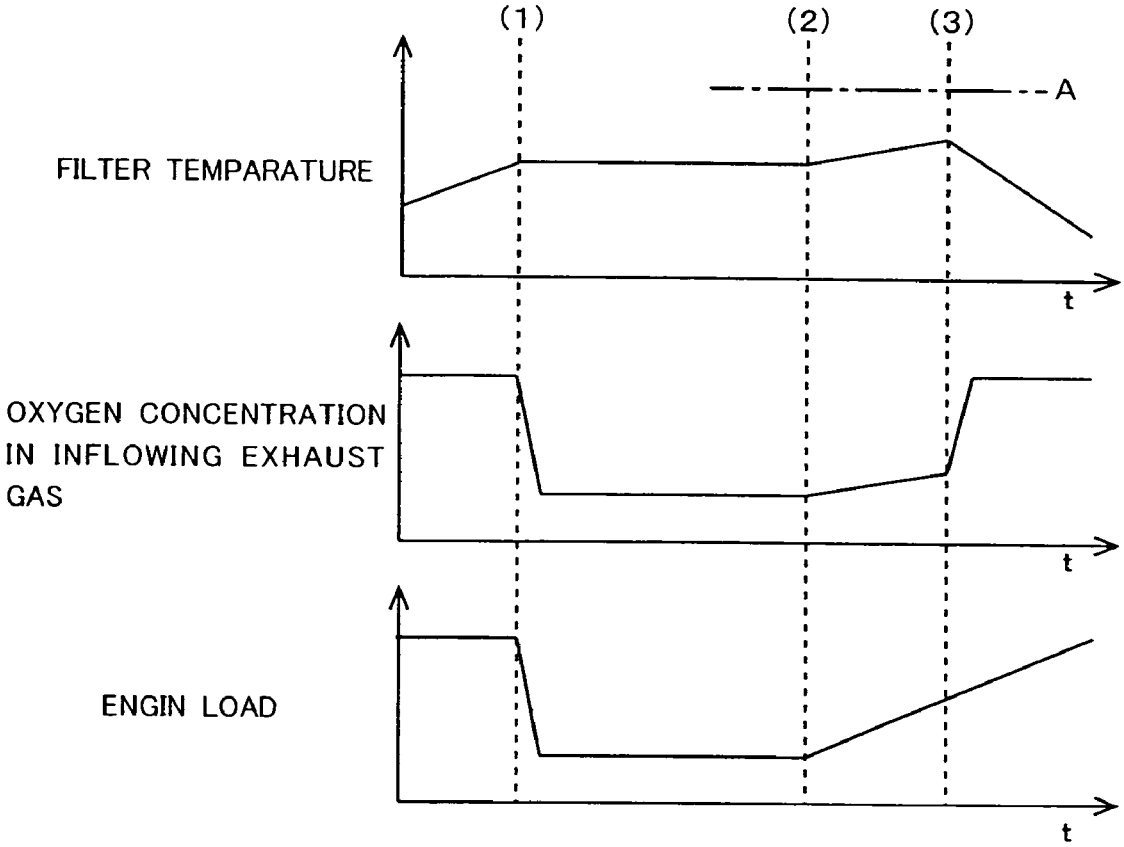
FIG. 2 is a time chart during a filter regeneration process, showing changes in the temperature of a filter, the oxygen concentration in the inflowing exhaust gas and the engine load of the internal combustion engine.

Next, a control process of the oxygen concentration in the inflowing exhaust gas in the filter regeneration process in this embodiment will be described with reference to FIG. 2. FIG. 2 is a time chart during the filter regeneration process, showing changes in the temperature of the filter 3, the oxygen concentration in the inflowing exhaust gas and the engine load of the internal combustion engine.

During the filter regeneration process, the oxygen concentration in the inflowing exhaust gas is made high in order to facilitate oxidation of the particulate matter. In addition, the filter 3 is raised to a high temperature. In doing so, the temperature of the filter 3 is raised gradually so as to restrict an excessive temperature rise of the filter 3. At time (1) in FIG. 2, the running state of the internal combustion engine shifts to idle running. Once the running state of the internal combustion engine 1 shifts to idle running, the engine load of the internal combustion engine decreases and the intake air quantity also decreases. Furthermore, the flow quantity of the exhaust gas also decreases with the decrease in the intake air quantity.

Since the decrease in the flow quantity of the exhaust gas results in a decrease in the quantity of the removed heat, the temperature of the filter 3 rises and the risk of an excessive temperature rise arises. In view of this, in this embodiment, when the running state of the internal combustion engine is shifted to idle running, the oxygen concentration in the inflowing exhaust gas is reduced. With the reduction in the oxygen concentration in the inflowing exhaust gas, oxidation of the particulate matter in the filter 3 is retarded, so that a rise in the temperature of the filter is restricted. Thus, it is possible to restrict an excessive temperature rise of the filter 3.

In this embodiment, the oxygen concentration in the inflowing exhaust gas is reduced by making the opening of the throttle valve 8 small and, in addition, increasing the injection quantity in sub fuel injection in the internal combustion engine 1. The sub fuel injection is a fuel injection that is performed during the period in which its influence on the engine load of the internal combustion engine is small. With the reduction of the opening of the throttle valve 8, the intake air quantity is reduced. Consequently, the oxygen concentration in the exhaust gas discharged from the internal combustion engine 1 is reduced. With the increase in the quantity of the fuel injected by the sub fuel injection, the quantity of oxygen consumed upon oxidation of the fuel by the oxidizing catalyst 6 is increased. Thus, the oxygen concentration in the inflowing exhaust gas is further reduced. As per the above, the oxygen concentration in the inflowing exhaust gas can be controlled by changing the opening of the throttle valve 8 and the injection quantity in the sub fuel injection.

In connection with the above, the sub fuel injection may be performed by a VIGOM injection that is effected near the top dead center in the exhaust stroke and by a post injection effected in the expansion stroke or the exhaust stroke after the main fuel injection. This is because the fuel injected by the VIGOM injection and the post injection is hardly subjected to the combustion in the internal combustion engine 1. An additional reason is that when the VIGOM injection is effected, the ignitionability of the air-fuel mixture in the combustion chamber is improved and reduction of the intake air quantity is facilitated.

In addition, with the increase in the injection quantity in the sub fuel injection, the heat quantity generated by oxidation of the fuel by the oxidizing catalyst 6 increases, so that the risk of a rise in the temperature of the filter 3 arises. In view of this, the intake air quantity may be reduced at the time of the sub fuel injection to decrease the oxygen concentration in the inflowing exhaust gas while restricting the injection quantity in the sub fuel injection. However, in the case that the filter 3 has a high heat resistant temperature, the oxygen concentration of the inflowing exhaust gas may be reduced only by increasing the injection quantity in the sub fuel injection.

Furthermore, instead of increasing the injection quantity in the sub fuel injection, the quantity of the fuel addition by the fuel addition valve 5 may be increased. Alternatively, both the quantity of the fuel addition by the fuel addition valve 5 and the quantity of the sub fuel injection may be increased.

Next, at time (2) in FIG. 2, the running state of the internal combustion engine 1 is shifted from idle running to a running state in which the engine load is higher than in the idle running. Once the running state of the internal combustion engine 1 shifts to a running state in which the engine load is higher than in the idle running, the intake air quantity increases. Then, the flow quantity of the exhaust gas also increases with the increase in the intake air quantity.

Since the increase in the flow quantity of the exhaust gas results in an increase in the quantity of the removed heat, the temperature of the filter 3 is difficult to raise. However, since removal of the particulate matter from the filter 3 has proceeded little during the period in which the oxygen concentration in the inflowing exhaust gas have been made low (i.e. the period between time (1) and time (2) in FIG. 2), if the oxygen concentration in the inflowing exhaust gas increases rapidly at that time, the particulate matter remaining on the filter 3 without being removed will be oxidized rapidly, so that the temperature of the filter can rise steeply to cause an excessive temperature rise.

In view of the above, in this embodiment, when the running state of the internal combustion engine 1 shifts to a running state in which the engine load is higher than in the idle running, the oxygen concentration in the inflowing exhaust gas is gradually increased as seen in the time period between (2) and (3) in FIG. 2. When the oxygen concentration in the inflowing exhaust gas is gradually increased, oxidation of the particulate matter in the filter 3 will proceed not steeply but gradually. Therefore, a steep temperature rise is restricted. Consequently, it is possible to restrict an excessive temperature rise more reliably. In connection with the above, the temperature indicated by dashed line A in FIG. 2 is the criterion for the excessive temperature rise. Namely, when the temperature of the filter 3 rises to that temperature, it is determined that the excessive temperature rise occurs. Therefore, when the oxygen concentration in the inflowing exhaust gas is increased on the occasion that the running state of the internal combustion engine 1 shifts from idle running to a running state with a higher engine load, its increasing amount per unit time, namely the increasing rate in the oxygen concentration in the inflowing exhaust gas is controlled in such a way that the temperature of the filter 3 will not reach the temperature indicated by dashed line A in FIG. 2.

In this embodiment, the oxygen concentration in the inflowing exhaust gas is gradually increased by at least one of gradually increasing the opening of the throttle valve 8 and gradually reducing the injection quantity in the sub fuel injection.

When the running condition of the internal combustion engine 1 shifts from idle running to a running state with a higher engine load, the intake air quantity will increase with the increase in the engine load. As a result, the flow quantity of the exhaust gas increases, and the quantity of the removed heat is also increases. Then, the intake air quantity reaches a specified intake air quantity at time (3) in FIG. 2. The specified intake air quantity is such a quantity that when the intake air quantity becomes equal to or larger than the specified intake air quantity, the flow quantity of the exhaust gas will become larger than or equal to a specified flow quantity of the exhaust gas. The specified flow quantity of the exhaust gas is such a flow quantity that when the flow quantity of the exhaust gas becomes larger than or equal to the specified flow quantity of the exhaust gas, the quantity of the removed heat becomes larger than or equal to the quantity of heat generated by oxidation of the particulate matter. When the quantity of the removed heat becomes larger than or equal to the quantity of the heat generate by oxidation of the particulate matter, the temperature of the filter 3 starts to fall. Then, an excessive temperature rise of the filter hardly occurs, even if the oxygen concentration in the inflowing exhaust gas increases to some extent.

In view of the above, in this embodiment, when the intake air quantity increases to the specified intake air quantity, restriction of the increase in the oxygen concentration in the inflowing exhaust gas is prohibited. In other words, a control process for restricting a steep increase in the oxygen concentration in the inflowing exhaust gas is suspended. Specifically, a control process for realizing a gradual increase in the opening of the throttle valve 8 to restrict a steep increase in the intake air quantity and/or a control process for realizing a gradual decrease in the injection quantity in the sub fuel injection to restrict a steep decrease in the sub fuel injection quantity is suspended, and the control process is changed to a normal control process.

By prohibiting the restriction of the increase in the oxygen concentration in the inflowing exhaust gas at time (3) in FIG. 2, it is possible to increase the oxygen concentration in the exhaust gas at an earlier stage while restricting an excessive temperature rise of the filter 3. Therefore, since it is possible to steeply reduce the injection quantity in the sub fuel injection or to stop the sub fuel injection, unburned components (or fuel) can be restricted from being emitted to the atmosphere. In addition, when the filter generation process is continued, the removal of the particulate matter from the filter 3 can be restarted at an earlier stage. In addition, a decrease in gas mileage can be restricted.

As described above, in this embodiment, the intake air quantity is decreased by reducing the opening of the throttle valve 8 and the injection quantity in the sub fuel injection is increased at time (1) in FIG. 2, in order to reduce the oxygen concentration in the inflowing exhaust gas. In that process, a target sub fuel injection quantity and a target intake air quantity for realizing a target oxygen concentration in the inflowing exhaust gas are calculated based on the running state of the internal combustion engine 1 and the temperature of the filter 3.

In this embodiment, the target sub fuel injection quantity and the target intake air quantity may further be corrected based on at least one of the atmospheric temperature detected by the atmospheric temperature sensor 12 and the atmospheric pressure detected by the atmospheric pressure sensor 13.

Specifically, in the case that the atmospheric pressure is low or the atmospheric temperature is high, the target sub fuel injection quantity and the target reducing agent addition quantity are decreased by the correction, since in that case the quantity of the oxygen contained in the same volume of air is relatively small as compared to the case in which the atmospheric pressure or the atmospheric temperature is normal. On the other hand, in the case that the atmospheric temperature is low, the target sub fuel injection quantity and the target reducing agent addition quantity are increased by the correction, since in that case the quantity of the oxygen contained in the same volume of air is relatively large as compared to the case in which the atmospheric temperature is normal.

By the above-described correction, it is possible to control the oxygen concentration in the inflowing exhaust gas to the target oxygen concentration with improved accuracy. Accordingly, it is possible to control the temperature of the filter 3 more accurately, and therefore an excessive temperature rise of the filter 3 can be restricted more reliably.

In the period from time (2) to time (3) in FIG. 2, the rate of the gradual increase in the intake air quantity and the rate of the gradual decrease in the sub fuel injection quantity may be corrected base on at least one of the atmospheric temperature or the atmospheric pressure as with the above-described case.

In the process of controlling the oxygen concentration in the inflowing exhaust gas as described above, if fuel addition by the fuel addition valve 5 is performed in place of or in addition to the sub fuel injection, the quantity of the fuel added by the fuel addition valve 5 is controlled in a manner similar to the injection quantity in the sub fuel injection.

The oxygen concentration in the inflowing exhaust gas may be increased or decreased by controlling a combustion condition in the internal combustion engine 1 without performing the sub fuel injection or the fuel addition by the fuel addition valve 5.

Figure 3:
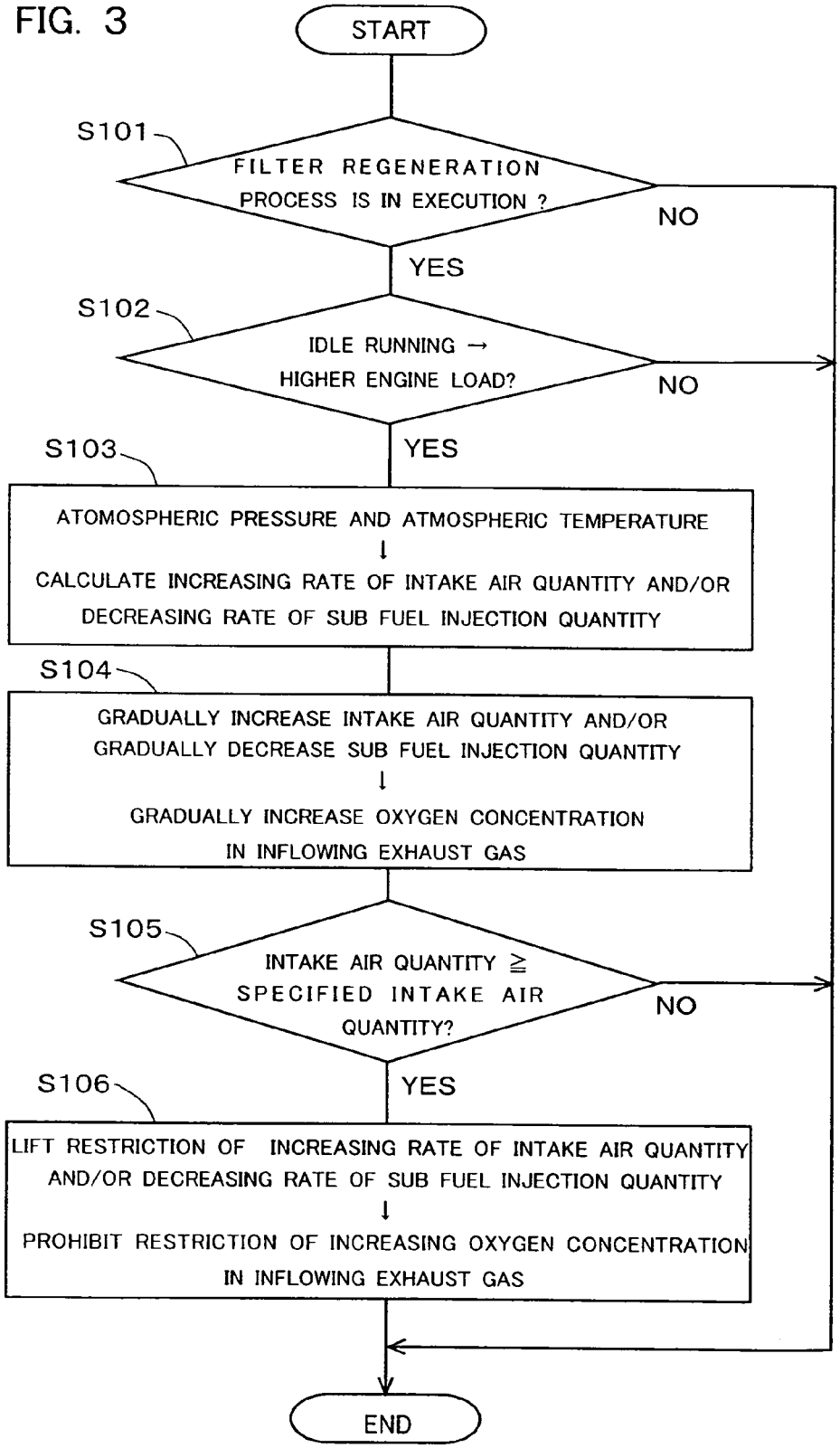
FIG. 3 is a flow chart of a control routine for increasing the oxygen concentration in the inflowing exhaust gas when the running state of the internal combustion engine shifts from idle running to a running state with a higher engine load during the filter regeneration process.

In the following, a control routine for increasing the oxygen concentration in the inflowing exhaust gas when the running state of the internal combustion engine 1 shifts from idle running to a running state with a higher engine load during the filter regeneration process will be described with reference to the flow chart of FIG. 3. The control routine shown in FIG. 3 is stored in the ECU 10 in advance and executed every time the crankshaft rotates a specified angle.

In this routine, firstly in S101, the ECU 10 determines whether the filter regeneration process is currently in execution or not. When an affirmative determination is made in step S101, the control flow proceeds to step S102, whereas when a negative determination is made in step S101, the execution of this routine is terminated.

In S102, the ECU 10 determines whether the running state of the internal combustion engine has shifted from idle running to a running state with a higher engine load or not. When an affirmative determination is made in step S102, the control flow proceeds to step S103, whereas when a negative determination is made in step S102, the execution of this routine is terminated.

In S103, the ECU 10 calculates, in the case that the oxygen concentration in the inflowing exhaust gas is increased by increasing the intake air quantity, the rate of the increase in the intake air quantity based on the atmospheric pressure and the atmospheric temperature, and in the case that the oxygen concentration in the inflowing exhaust gas is increased by decreasing the sub fuel injection quantity, the rate of the decrease in the sub fuel injection quantity based on the atmospheric pressure and the atmospheric temperature.

Next, the process of the ECU 10 proceeds to S104, in which the ECU 10 starts at least one of the control process for gradually increasing the intake air quantity in accordance with the increasing rate calculated in S103 and the control process for gradually decreasing the sub fuel injection quantity in accordance with the decreasing rate calculated in S103, to gradually increase the oxygen concentration in the inflowing exhaust gas.

Next, the process of the ECU 10 proceeds to S105, in which it is determined whether or not the intake air quantity is larger than or equal to a specified intake air quantity. When an affirmative determination is made in step S105, the control flow proceeds to step S106, whereas when a negative determination is made in step S105, the execution of this routine is terminated.

In S106, the ECU 10 lifts the restriction of the rate of the increase in the intake air quantity and/or the rate of the decrease in the sub fuel injection quantity. In other words, the ECU 10 prohibits restriction of an increase in the oxygen concentration in the inflowing exhaust gas by suspending the control process for restricting a rapid increase in the intake air quantity and/or the control process for restricting a rapid decrease in the sub fuel injection quantity and changing the control process to a normal control process. Then, the ECU 10 terminates the execution of this routine.

By the above-described control routine, an excessive temperature rise of the filer 3 by performing oxidation of the particulate matter in the filter 3 rapidly can be restricted more reliably even when the running state of the internal combustion engine 1 shifts from idle running to a running state with a higher engine load. In addition, it is possible to increase the oxygen concentration in the exhaust gas at an earlier stage while restricting an excessive temperature rise of the filter.

According to the method for restricting an excessive temperature rise of a filter in an internal combustion engine in accordance with the present invention, it is possible to restrict an excessive temperature rise of a filter more reliably.

While the invention has been described in terms of a preferred embodiment, those skilled in the art will recognize that the invention can be practiced with modifications within the spirit and scope of the appended claims.

What is claimed is:

1. A method for restricting an excessive temperature rise of a filter in an internal combustion engine, the internal combustion engine having a filter provided in an exhaust passage for collecting particulate matter contained in exhaust gas, wherein when the amount of particulate matter depositing on the filter becomes equal to or larger than a specified deposition amount, the temperature of the filter is raised to oxidize and remove the particulate matter depositing on the filter, the method comprising:

a first step of decreasing, when a condition with which it is anticipated that the temperature of said filter will become equal to or higher than a specified temperature is established while the removal of particulate matter from said filter is performed, the oxygen concentration in exhaust gas flowing into said filter; and a second step of gradually increasing, when said condition expires after the first step, the oxygen concentration in the exhaust gas flowing into said filter;

wherein the establishment of said condition corresponds to the time when the running state of said internal combustion engine becomes idle running, and the expiration of said condition corresponds to the time when the running state of said internal combustion engine becomes a running state with an engine load higher than in the idle running.

2. A method for restricting an excessive temperature rise of a filter in an internal combustion engine according to claim 1, wherein when the intake air quantity in said internal combustion engine becomes larger than or equal to a specified intake air quantity after the expiration of said condition, restriction of an increase in the oxygen concentration in the exhaust gas flowing into said filter is prohibited.

3. A method for restricting an excessive temperature rise of a filter in an internal combustion engine, the internal combustion engine having a filter provided in an exhaust passage for collecting particulate matter contained in exhaust gas, wherein when the amount of particulate matter depositing on the filter becomes equal to or larger than a specified deposition amount, the temperature of the filter is raised to oxidize and remove the particulate matter depositing on the filter, the method comprising:

a first step of decreasing, when a condition with which it is anticipated that the temperature of said filter will become equal to or higher than a specified temperature is established while the removal of particulate matter from said filter is performed, the oxygen concentration in exhaust gas flowing into said filter; and a second step of gradually increasing, when said condition expires after the first step, the oxygen concentration in the exhaust gas flowing into said filter;

wherein the establishment of said condition corresponds to the time when the running state of said internal combustion engine becomes a low load running in which the flow rate of the exhaust gas flowing into said filter is so low that the temperature of the filter is easy to rise, and the expiration of said condition corresponds to the time when the running state of said internal combustion engine shifts from the low load running in which the flow rate of the exhaust gas flowing into said filter is so low that the temperature of the filter is easy to rise to a high load running.

4. A method for restricting an excessive temperature rise of a filter in an internal combustion engine according to claim 3, wherein when the intake air quantity in said internal combustion engine becomes larger than or equal to a specified intake air quantity after the expiration of said condition, restriction of an increase in the oxygen concentration in the exhaust gas flowing into said filter is prohibited.

5. A method for restricting an excessive temperature rise of a filter in an internal combustion engine, the internal combustion engine having a filter provided in an exhaust passage for collecting particulate matter contained in exhaust gas, wherein when the amount of particulate matter depositing on the filter becomes equal to or larger than a specified deposition amount, the temperature of the filter is raised to oxidize and remove the particulate matter depositing on the filter, the method comprising:

a first step of decreasing, when a condition with which it is anticipated that the temperature of said filter will become equal to or higher than a specified temperature is established while the removal of particulate matter from said filter is performed, the oxygen concentration in exhaust gas flowing into said filter; and a second step of gradually increasing, when said condition expires after the first step, the oxygen concentration in the exhaust gas flowing into said filter;

wherein the oxygen concentration in the exhaust gas flowing into said filter is decreased or increased by controlling a combustion state in said internal combustion engine; and wherein the establishment of said condition corresponds to the time when the running state of said internal combustion engine becomes idle running, and the expiration of said condition corresponds to the time when the running state of said internal combustion engine becomes a running state with an engine load higher than in the idle running.

6. A method for restricting an excessive temperature rise of a filter in an internal combustion engine according to claim 5, wherein when the intake air quantity in said internal combustion engine becomes larger than or equal to a specified intake air quantity after the expiration of said condition, restriction of an increase in the oxygen concentration in the exhaust gas flowing into said filter is prohibited.

7. A method for restricting an excessive temperature rise of a filter in an internal combustion engine, the internal combustion engine having a filter provided in an exhaust passage for collecting particulate matter contained in exhaust gas, wherein when the amount of particulate matter depositing on the filter becomes equal to or larger than a specified deposition amount, the temperature of the filter is raised to oxidize and remove the particulate matter depositing on the filter, the method comprising:

a first step of decreasing, when a condition with which it is anticipated that the temperature of said filter will become equal to or higher than a specified temperature is established while the removal of particulate matter from said filter is performed, the oxygen concentration in exhaust gas flowing into said filter; and a second step of gradually increasing, when said condition expires after the first step, the oxygen concentration in the exhaust gas flowing into said filter;

wherein the oxygen concentration in the exhaust gas flowing into said filter is decreased or increased by controlling a combustion state in said internal combustion engine;

wherein the establishment of said condition corresponds to the time when the running state of said internal combustion engine becomes a low load running in which the flow rate of the exhaust gas flowing into said filter is so low that the temperature of the filter is easy to rise, and the expiration of said condition corresponds to the time when the running state of said internal combustion engine shifts from the low load running in which the flow rate of the exhaust gas flowing into said filter is so low that the temperature of the filter is easy to rise to a high load running.

8. A method for restricting an excessive temperature rise of a filter in an internal combustion engine according to claim 7, wherein when the intake air quantity in said internal combustion engine becomes larger than or equal to a specified intake air quantity after the expiration of said condition, restriction of an increase in the oxygen concentration in the exhaust gas flowing into said filter is prohibited.

9. A method for restricting an excessive temperature rise of a filter in an internal combustion engine, the internal combustion engine having a filter provided in an exhaust passage for collecting particulate matter contained in exhaust gas, wherein when the amount of particulate matter depositing on the filter becomes equal to or larger than a specified deposition amount, the temperature of the filter is raised to oxidize and remove the particulate matter depositing on the filter, the method comprising:

a first step of decreasing, when a condition with which it is anticipated that the temperature of said filter will become equal to or higher than a specified temperature is established while the removal of particulate matter from said filter is performed, the oxygen concentration in exhaust gas flowing into said filter; and a second step of gradually increasing, when said condition expires after the first step, the oxygen concentration in the exhaust gas flowing into said filter;

wherein:

said internal combustion engine is provided with a catalyst having an oxidizing function, said catalyst being provided in at least one of the state carried on said filter and the state provided in said exhaust passage upstream of said filter;

the oxygen concentration in the exhaust gas flowing into said filter is decreased or increased by adjusting at least one of the injection quantity in sub fuel injection effected in said internal combustion engine during a period other than main fuel injection and the addition quantity of a reducing agent added to the exhaust gas upstream of said filter; and the establishment of said condition corresponds to the time when the running state of said internal combustion engine becomes idle running, and the expiration of said condition corresponds to the time when the running state of said internal combustion engine becomes a running state with an engine load higher than in the idle running.

10. A method for restricting an excessive temperature rise of a filter in an internal combustion engine according to claim 9, wherein when the oxygen concentration in the exhaust gas flowing into said filter is gradually increased, at least one of the injection quantity in the sub fuel injection and the addition quantity of the reducing agent added to the exhaust gas is gradually decreased, and the decreasing rate thereof is corrected based on at least one of the atmospheric pressure and the atmospheric temperature.

11. A method for restricting an excessive temperature rise of a filter in an internal combustion engine according to claim 9, wherein when the intake air quantity in said internal combustion engine becomes larger than or equal to a specified intake air quantity after the expiration of said condition, restriction of an increase in the oxygen concentration in the exhaust gas flowing into said filter is prohibited.

12. A method for restricting an excessive temperature rise of a filter in an internal combustion engine according to claim 9, wherein:

the oxygen concentration in the exhaust gas flowing into said filter is decreased or increased by adjusting the intake air quantity in said internal combustion engine in addition to adjusting at least one of the injection quantity in said sub fuel injection and the addition quantity of said reducing agent; and a target intake air quantity serving as a target in adjusting said intake air quantity is corrected based on a condition of the atmosphere.

13. A method for restricting an excessive temperature rise of a filter in an internal combustion engine according to claim 12, wherein when the oxygen concentration in the exhaust gas flowing into said filter is gradually increased, the intake air quantity is gradually increased, and the increasing rate thereof is corrected based on at least one of the atmospheric pressure and the atmospheric temperature.

14. A method for restricting an excessive temperature rise of a filter in an internal combustion engine according to claim 9, wherein a target sub fuel injection quantity serving as a target in adjusting the injection quantity in said sub fuel injection and a target reducing agent addition quantity sewing as a target in adjusting the addition amount of said reducing agent are corrected based on a condition of the atmosphere.

15. A method for restricting an excessive temperature rise of a filter in an internal combustion engine according to claim 14, wherein the lower the atmospheric pressure is, or the higher the atmospheric temperature is, the smaller said target sub fuel injection quantity and said target reducing agent addition quantity are made by the correction.

16. A method for restricting an excessive temperature rise of a filter in an internal combustion engine according to claim 14, wherein:

the oxygen concentration in the exhaust gas flowing into said filter is decreased or increased by adjusting the intake air quantity in said internal combustion engine in addition to adjusting at least one of the injection quantity in said sub fuel injection and the addition quantity of said reducing agent; and a target intake air quantity serving as a target in adjusting said intake air quantity is corrected based on a condition of the atmosphere.

17. A method for restricting an excessive temperature rise of a filter in an internal combustion engine, the internal combustion engine having a filter provided in an exhaust passage for collecting particulate matter contained in exhaust gas, wherein when the amount of particulate matter depositing on the filter becomes equal to or larger than a specified deposition amount, the temperature of the filter is raised to oxidize and remove the particulate matter depositing on the filter, the method comprising:

a first step of decreasing, when a condition with which it is anticipated that the temperature of said filter will become equal to or higher than a specified temperature is established while the removal of particulate matter from said filter is performed, the oxygen concentration in exhaust gas flowing into said filter; and a second step of gradually increasing, when said condition expires after the first step, the oxygen concentration in the exhaust gas flowing into said filter;

wherein:

said internal combustion engine is provided with a catalyst having an oxidizing function, said catalyst being provided in at least one of the state carried on said filter and the state provided in said exhaust passage upstream of said filter;

the oxygen concentration in the exhaust gas flowing into said filter is decreased or increased by adjusting at least one of the injection quantity in sub fuel injection effected in said internal combustion engine during a period other than main fuel injection and the addition quantity of a reducing agent added to the exhaust gas upstream of said filter; and the establishment of said condition corresponds to the time when the running state of said internal combustion engine becomes a low load running in which the flow rate of the exhaust gas flowing into said filter is so low that the temperature of the filter is easy to rise, and the expiration of said condition corresponds to the time when the running state of said internal combustion engine shifts from the low load running in which the flow rate of the exhaust gas flowing into said filter is so low that the temperature of the filter is easy to rise to a high load running.

18. A method for restricting an excessive temperature rise of a filter in an internal combustion engine according to claim 17, wherein when the oxygen concentration in the exhaust gas flowing into said filter is gradually increased, at least one of the injection quantity in the sub fuel injection and the addition quantity of the reducing agent added to the exhaust gas is gradually decreased, and the decreasing rate thereof is corrected based on at least one of the atmospheric pressure and the atmospheric temperature.

19. A method for restricting an excessive temperature rise of a filter in an internal combustion engine according to claim 17, wherein when the intake air quantity in said internal combustion engine becomes larger than or equal to a specified intake air quantity after the expiration of said condition, restriction of an increase in the oxygen concentration in the exhaust gas flowing into said filter is prohibited.

20. A method for restricting an excessive temperature rise of a filter in an internal combustion engine according to claim 17, wherein:

the oxygen concentration in the exhaust gas flowing into said filter is decreased or increased by adjusting the intake air quantity in said internal combustion engine in addition to adjusting at least one of the injection quantity in said sub fuel injection and/or the addition quantity of said reducing agent; and a target intake air quantity serving as a target in adjusting said intake air quantity is corrected based on a condition of the atmosphere.

21. A method for restricting an excessive temperature rise of a filter in an internal combustion engine according to claim 20, wherein when the oxygen concentration in the exhaust gas flowing into said filter is gradually increased, the intake air quantity is gradually increased, and the increasing rate thereof is corrected based on at least one of the atmospheric pressure and the atmospheric temperature.

22. A method for restricting an excessive temperature rise of a filter in an internal combustion engine according to claim 17, wherein a target sub fuel injection quantity serving as a target in adjusting the injection quantity in said sub fuel injection and a target reducing agent addition quantity serving as a target in adjusting the addition amount of said reducing agent are corrected based on a condition of the atmosphere.

23. A method for restricting an excessive temperature rise of a filter in an internal combustion engine according to claim 22, wherein the lower the atmospheric pressure is, or the higher the atmospheric temperature is, the smaller said target sub fuel injection quantity and said target reducing agent addition quantity are made by the correction.

24. A method for restricting an excessive temperature rise of a filter in an internal combustion engine according to claim 22, wherein:

the oxygen concentration in the exhaust gas flowing into said filter is decreased or increased by adjusting the intake air quantity in said internal combustion engine in addition to adjusting at least one of the injection quantity in said sub fuel injection and the addition quantity of said reducing agent; and a target intake air quantity serving as a target in adjusting said intake air quantity is corrected based on a condition of the atmosphere.

* * * * *

UNITED STATES PATENT AND TRADEMARK OFFICE

CERTIFICATE OF CORRECTION

PATENT NO. : 7,159,391 B2
APPLICATION NO. : 10/936606
DATED : January 9, 2007
INVENTOR(S) : Tomoyuki Kogo and Takeshi Hashizume It is certified that error appears in the above-identified patent and that said Letters Patent is hereby corrected as shown below:

Column 15, Line 44

Change "sewing" to --serving--.

Signed and Sealed this

Eleventh Day of March, 2008

JON W. DUDAS
*Director of the United States Patent and Trademark Office*